US009776397B2

(12) United States Patent
Ge et al.

(10) Patent No.: US 9,776,397 B2
(45) Date of Patent: Oct. 3, 2017

(54) ADDRESSING AN EPROM ON A PRINTHEAD

(71) Applicant: HEWLETT-PACKARD DEVELOPMENT COMPANY, L.P., Houston, TX (US)

(72) Inventors: Ning Ge, Palo Alto, CA (US); Reynaldo V Villavelez, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/300,613

(22) PCT Filed: Apr. 17, 2014

(86) PCT No.: PCT/US2014/034456

§ 371 (c)(1),
(2) Date: Sep. 29, 2016

(87) PCT Pub. No.: WO2015/160350

PCT Pub. Date: Oct. 22, 2015

(65) Prior Publication Data

US 2017/0106648 A1 Apr. 20, 2017

(51) Int. Cl.
*B41J 2/045* (2006.01)

(52) U.S. Cl.
CPC ..... *B41J 2/04541* (2013.01); *B41J 2/04586* (2013.01)

(58) Field of Classification Search
CPC ..... B41J 2/0454; B41J 2/04586; B41J 2/135; B41J 29/393; H01L 27/115;
(Continued)

(56) References Cited

U.S. PATENT DOCUMENTS 4,567,570 A 1/1986 Peer
5,151,876 A * 9/1992 Ikeda ..... G06K 15/02 358/1.11

(Continued)

FOREIGN PATENT DOCUMENTS

KR 10-2008-0066062 A 7/2008

OTHER PUBLICATIONS

Intel Corporation. Operating and Reference Manual; Sep. 18, 2003.

*Primary Examiner* — Huan Tran
*Assistant Examiner* — Alexander D Shenderov
(74) *Attorney, Agent, or Firm* — HP Inc. Patent Department

(57) ABSTRACT

Addressing an EPROM on a printhead is described. In an example, a printhead includes an electronically programmable read-only memory (EPROM) having a bank of cells arranged in rows and columns, each of the cells having a addressing port, a row select port, and a column select port. A conductor is coupled to the addressing portion of each of the cells. A shift register circuit is coupled to at least one of the row select port and the column select port of each of the cells, the shift register circuit storing samples of an input signal responsive to a plurality of clock signals. A decoder is coupled to the shift register circuit to provide the input signal based on a logical combination of a plurality of data signals and at least a portion of the clock signals.

10 Claims, 11 Drawing Sheets

100

(58) Field of Classification Search
CPC ..... H01L 21/8247; H01L 29/788; G11C 7/00; G01R 31/02; G01N 27/447
USPC ..... 347/12
See application file for complete search history.

(56) References Cited

U.S. PATENT DOCUMENTS

| | | | | |
|---|---|---|---|---|
| 5,341,092 | A | 8/1994 | El-Ayat et al. | |
| 5,768,196 | A | 6/1998 | Bloker et al. | |
| 2002/0029971 | A1 | 3/2002 | Kovacs | |
| 2004/0208061 | A1 | 10/2004 | Toda | |
| 2007/0194371 | A1 | 8/2007 | Benjamin | |
| 2010/0067315 | A1 | 3/2010 | Park et al. | |
| 2010/0302293 | A1* | 12/2010 | Torgerson | B41J 2/04541 347/10 |
| 2011/0032296 | A1 | 2/2011 | Nakano et al. | |

* cited by examiner

700

ADDRESSING AN EPROM ON A PRINTHEAD

BACKGROUND

In inkjet printing systems, it is desirable to have several characteristics of each print cartridge easily identifiable by a controller, and it is desirable to have such identification information supplied directly by the print cartridge. The "identification information", for example, can provide information to the printer controller to adjust the operation of the printer and ensure correct operation. A print cartridge can store this identification information using a small, non-volatile memory, such as an erasable programmable read-only memory (EPROM). As print technology evolves, it is desirable to expand the EPROM to store more information. Larger EPROMs, however, lead to longer testing time during manufacture. Longer testing times results in a significant increase in manufacturing cost.

BRIEF DESCRIPTION OF THE DRAWINGS

Some embodiments of the invention are described with respect to the following figures.

DETAILED DESCRIPTION

Addressing an EPROM on a printhead is described. In an example, a printhead for a printer, such as an inkjet printer, includes an EPROM having a plurality of cells arranged in rows and columns. Each cell has a addressing port, a row select port, and a column select port. A conductor is coupled to the addressing port of each of the cells. A column shift register is coupled to the column select ports of the cells and includes a register location for each column of the cells. A row shift register is coupled to the row select ports of the cells and includes a register location for each row of the cells. The column shift register receives an input having a first data signal, and the row shift register receives an input having a second data signal. In operation, a row of the cells is selected by shifting an active logic state into a particular register location of the row shift register. A column of the cells is selected by shifting an active logic state into a particular register location of the column shift register. The conductor can be used to access a cell to retrieve its state (e.g., sense either logic '1' or logic '0' state) if selected by the column shift register and the row shift register.

In this manner, the row and column shift registers can be loaded in parallel to generate an address for the EPROM cell array. This is more efficient than a design having only a scheme of serial shift registers. While a single serial shift register scheme may require less control signals for the printhead, the address must be generated by serially shifting first the row portion and then the column portion. The larger the EPROM cell array, the longer it takes to generate a single address (e.g., in terms of clock cycles) and the longer it takes to read the EPROM (e.g., during testing). The dual bit-shift design described herein reduces the time it takes to generate a single address and thus the time it takes to read the EPROM.

Figure 1:
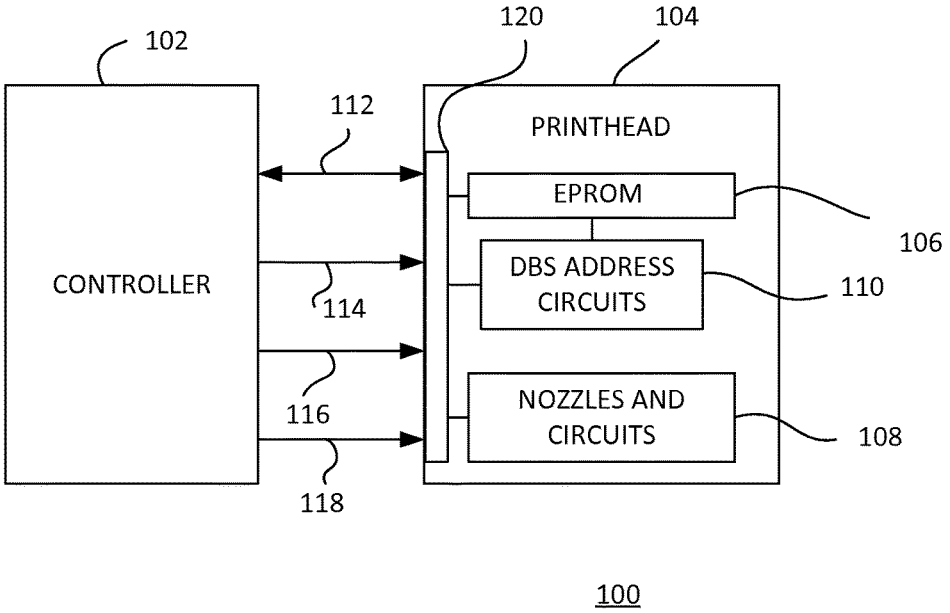
FIG. 1 is a block diagram depicting a printing subsystem according to an example implementation.

FIG. 1 is a block diagram depicting a printing subsystem 100 according to an example implementation. The subsystem 100 can be part of a larger printer system (not shown). The subsystem 100 includes a controller 102 and a printhead 104. The printhead 104 can be part of a larger system, such as an integrated printhead (IPH) system with an attached container (not shown). The printhead 104 includes various nozzles and associated circuits 108 for ejecting ink and printing to media. For example, the printhead 104 can be a thermal inkjet (TIJ) device, piezoelectric inkjet (PIJ) device, or the like.

Figure 4:
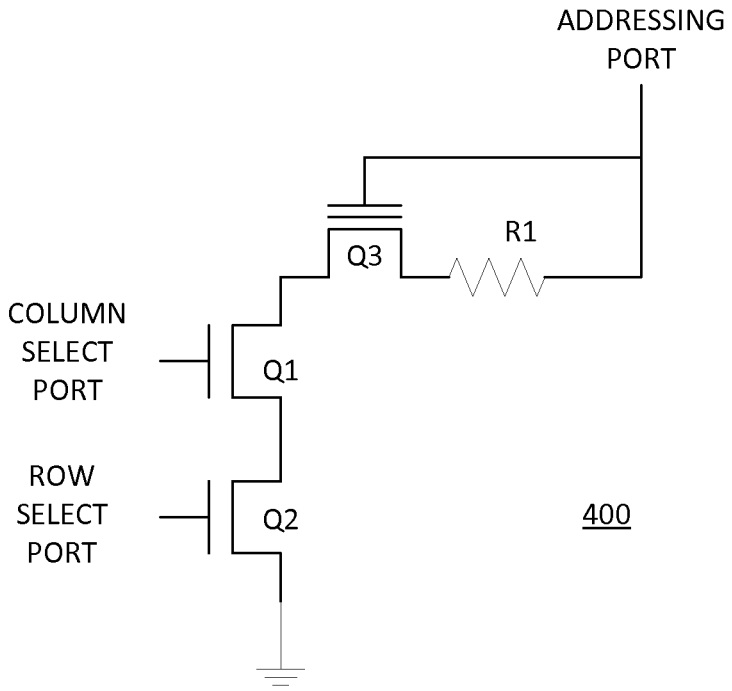
FIG. 4 is a schematic diagram showing an EPROM cell according to an example implementation.

The printhead 104 also includes an electronically programmable read only memory (EPROM) 106 and a dual bit-shift (DBS) address circuit 110. The EPROM 106 can be used to store various information related to the printhead 104 (or IPH), such as identification information, serial numbers, security information, feature information, and the like. As used herein, "EPROM" refers to a non-volatile memory having an array of cells arranged in rows and columns, where each cell can store a single bit of information. Each cell can be programmed with a particular logic state that is retained even when power is removed from the printhead 104. Once programmed, the EPROM 106 can be erased using a known process (e.g., exposure to a strong ultraviolet light source). However, in the context of the printhead 104, the EPROM 106 can be programmed during manufacture and thereafter remain programmed for the life of the printhead 104. Various circuitry for the cells can be used, such as configurations of floating gate field effect transistors (FETs) along with corresponding row and column select FETs. An example cell is shown in FIG. 4.

The EPROM 106 can be of a particular size, e.g., configured to store a particular number of bits. The DBS address circuit 110 can be used to address the EPROM 106 and select particular bits for access. As described below, the DBS address circuit 110 provides separate shift registers for row and column selection, which is more efficient in terms of access time than using a single shift register.

The controller 102 is configured to provide a plurality of signals to the printhead 104. The printhead 104 includes an external interface 120 for receiving the external signals from the controller 102 and providing the signals for use by the EPROM 106, the DBS address circuits 110, and the nozzles and circuits 108. The external interface 120 can include, for example, a sense line (referred to herein as ID line 112), data line(s) 114, clock line(s) 116, fire lines 118, and the like. The ID line 112 can be coupled to each cell in the EPROM 106 and can be used to access each cell (e.g., to read data). The data lines 114 can be used to drive the DBS address circuits 110 for addressing the EPROM 106. The clock lines 116 can be used to provide clock signals for use by logic on the printhead (e.g., the DBS address circuits 110). The fire lines 118 can be used to provide energy for ejecting ink from the nozzles 108. The external interface 120 shown in FIG. 1 is merely an example. Such an interface can include additional lines having different functions.

Figure 2:
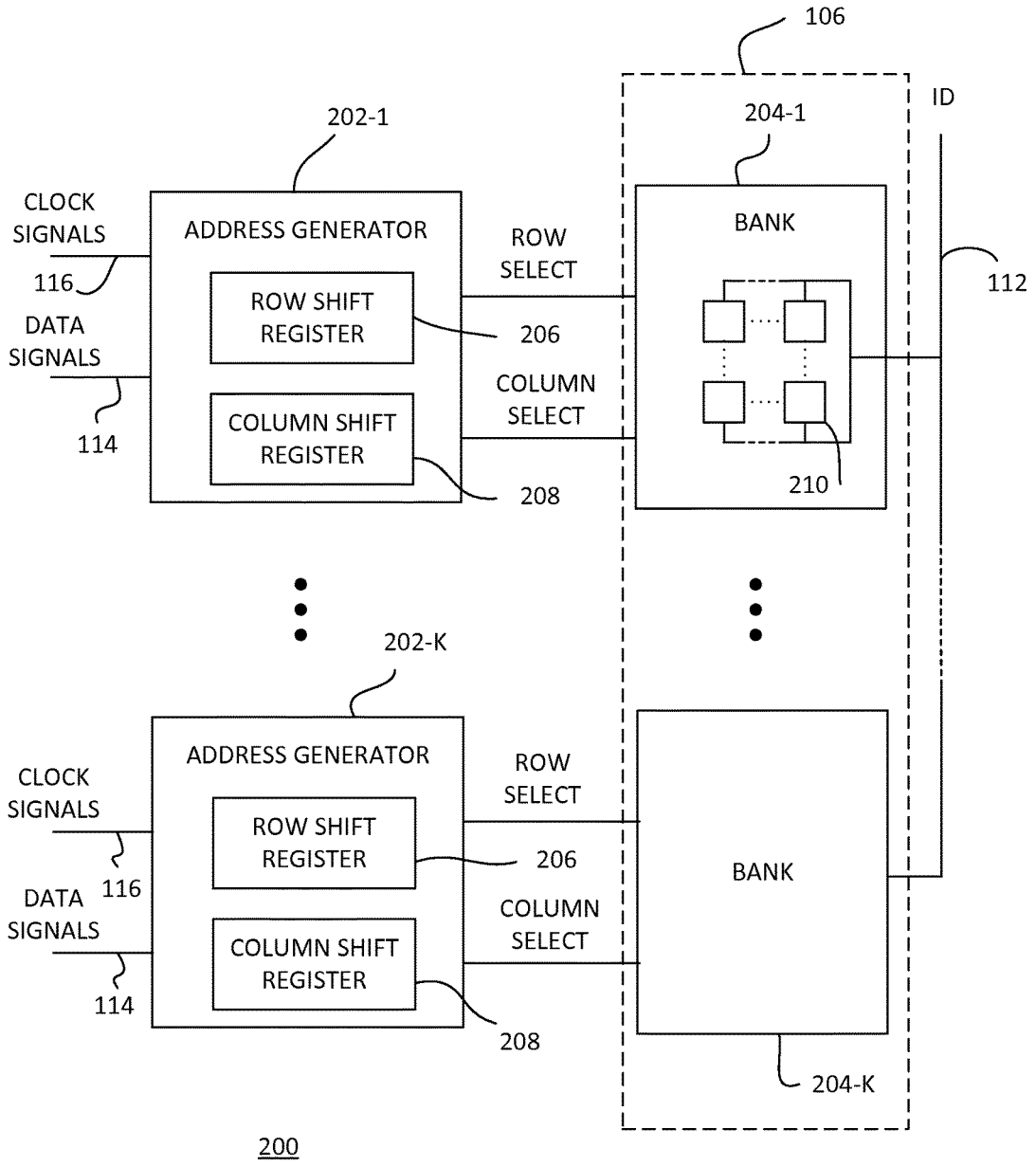
FIG. 2 is a block diagram showing an EPROM subsystem according to an example implementation.

FIG. 2 is a block diagram showing an EPROM subsystem 200 according to an example implementation. Elements of FIG. 2 that are the same or similar to FIG. 1 are designated with identical reference numerals. The EPROM 106 can include at least one bank 204-1 through 204-K, where K is an integer greater than zero (collectively bank(s) 204). Each of the banks 204 can include an array of cells each storing a bit of data. Each of the banks 204 is coupled to the ID line 112 such that each addressing port of each cell therein is coupled to the ID line 112. For example, that bank 204-1 is shown as having an array of cells 210 arranged in rows and columns. An addressing port of each of the cells 210 is coupled to the ID line 112. Banks 204-2 through 204-K are configured similarly. A particular one of the cells 210 can be accessed on the ID line 112 after selection using row and column select signals.

The banks 204-1 through 204-K receive row and column select signals from address generators 202-1 through 202-K (collectively address generators 202). Each of the address generators 202 includes a row shift register 206 and a column shift register 208. Each of the address generators receives clock signal(s) on the clock line(s) 116 and data signal(s) on the data line(s) 114. The row shift register 206 can include a plurality of register locations equal to the number of rows in the array of cells 210. The column shift register 208 can include a plurality of register locations equal to the number of columns in the array of cells 210.

The data signals (also referred to as control signals) can be used to push data into the row and column shift registers 206 and 208 using clock signals. For example, an active logic state (e.g., logic '1') can be pushed into the row shift register 206 to an Xth register location for selecting row X. An active logic state can be pushed into the column shift register 208 to a Yth register location for selecting column Y. In this manner, an address is generated for a cell 210 located in row X, column Y, allowing said cell to be accessed on the ID line 112. Notably, the row and column shift registers 206 and 208 can be configured in parallel in order to generate the desired address. This is more efficient than if a single shift register is used to generate both the row and column address, which would require row and column address information to be loaded serially.

Figure 3:
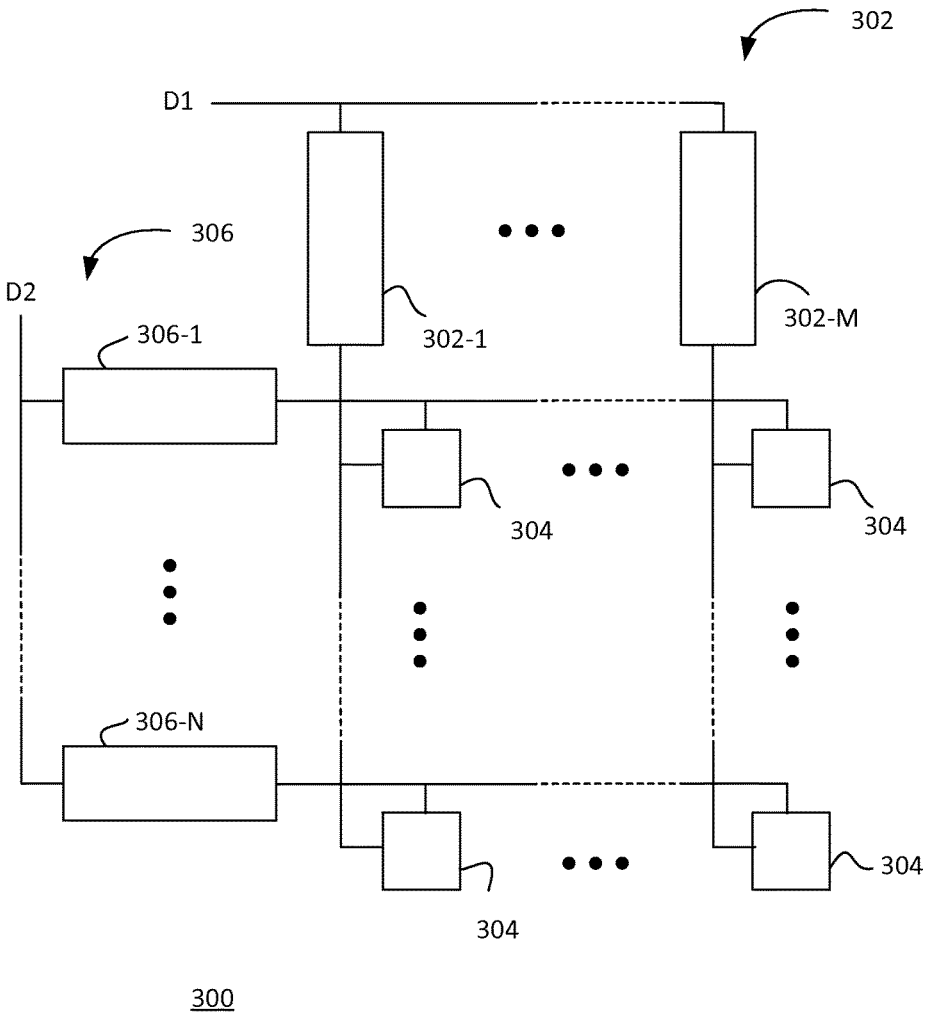
FIG. 3 is a block diagram depicting a more detailed portion of an EPROM subsystem according to an example implementation.

FIG. 3 is a block diagram depicting a more detailed portion of an EPROM subsystem 300 according to an example implementation. The EPROM subsystem 300 can comprise one bank and corresponding address generator of the subsystem in FIG. 2. Other banks/address generators in FIG. 2 can be configured similarly. The EPROM subsystem 300 includes a plurality of cells 304 arranged in rows and columns. A shift register 302 includes M register locations 302-1 through 302-M, where M is an integer greater than one. Each of the register locations 302-1 through 302-M is coupled to column select ports of the cells 304 in a particular column. Hence, the array of cells 304 includes M columns of cells. A shift register 306 includes N register locations 306-1 through 306-N, where N is an integer greater than one. Each of the register locations 306-1 through 306-N is coupled to row select ports of the cells 304 in a particular row. Hence, the array of cells 304 includes N rows of cells.

The shift register 302 receives a signal D1, and the shift register 306 receives a signal D2. The signals D1 and D2 may be provided on data lines, as described above. Clock inputs are omitted for clarity, but are shown in FIG. 2 and described above. In operation, the signal D1 can be used to store an active logic value in a particular register 302-Y to select column Y, and the signal D2 can be used to store an active logic value in a particular register 306-X to select row X. Hence, a cell 304 at row X, column Y can be selected and accessed (the ID line is omitted for clarity, but shown in FIG. 2 and described above.)

FIG. 4 is a schematic diagram showing an EPROM cell 400 according to an example implementation. The EPROM cell 400 includes transistors Q1 through Q3 and a resistor R1. The transistors Q1 and Q2 can be metal oxide field effect transistors (MOSFETs). The transistor Q3 can be a MOSFET with a floating gate. In an example, the transistors Q1 through Q3 are N-type (NMOS) devices, although a similar circuit can be constructed using PMOS or CMOS logic. A source of the transistor Q2 is coupled to a reference voltage (e.g., ground). A drain of the transistor Q2 is coupled to a source of the transistor Q1. The drain of the transistor Q1 is coupled to a source of the transistor Q3. A drain of the transistor Q3 is coupled to a terminal of the resistor R1. Another terminal of the resistor R1 is coupled to a addressing port of the cell 400. The gate of the transistor Q3 is also coupled to the addressing port. A gate of the transistor Q1 provides a column select port for receiving a column select signal. A gate of the transistor Q2 provides a row select port for receiving a row select signal. The transistor Q3 can be electrically accessed through the addressing port by switching on both the transistors Q1 and Q2.

The transistor Q3 is a floating-gate transistor in that the transistor Q3 includes two gates that are separated from one another by an oxide layer that acts as a dielectric. One of the gates is called a "floating gate" and the other is called a control gate or input gate. The floating gate's only link to the addressing port is through the control gate. A blank EPROM cell has all gates fully open, giving each cell a value of logic '0' (low resistance state). That is, the floating gate initially has no charge, which causes the threshold voltage to be low. To change the value of the bit to logic '1' (high resistance state), a programming voltage is applied to the control gate and drain (assuming the transistors Q1 and Q2 are switched on). The programming voltage draws excited electrons to the floating gate, thereby increasing the threshold voltage. The excited electrons are pushed through and trapped on the other side of the thin oxide layer, giving it a negative charge. These negatively charged electrons act as a barrier between the control gate and the floating gate. During use of the EPROM cell, a cell sensor can monitor the threshold voltage of the cell (assuming the transistors Q1 and Q2 are switched on). If the threshold voltage is low (below the threshold level), the cell has a value of logic '0'. If the threshold voltage is high (above the threshold level), the cell as a value of logic '1'.

FIG. 4 is one example structure of an EPROM cell that can be used with the circuits described above. In general, an EPROM cell must be able to store a bit of information in a non-volatile fashion and be accessible using row and column select signals.

Referring to FIG. 1, in some cases, the interface provided by the controller 102 includes limited data lines 114. For example, the controller 102 may provide four data signals for use by the printhead 104. In such an example, the DBS address circuits 110 only have four data signals to use to generate addresses for the EPROM 106. This would allow for a maximum of two uniquely addressable EPROM banks (two data signals for row and column selection in each bank). Notably, each cell in the EPROM is coupled to the same ID line for sensing. Thus, in cases where there are multiple banks of cells, two given banks cannot use the same input data signals for driving row and column shift registers, or else multiple cells would be coupled to the same ID line at the same time. More banks can be addressed given the same set of input data signals by multiplexing the data signals.

Figure 5:
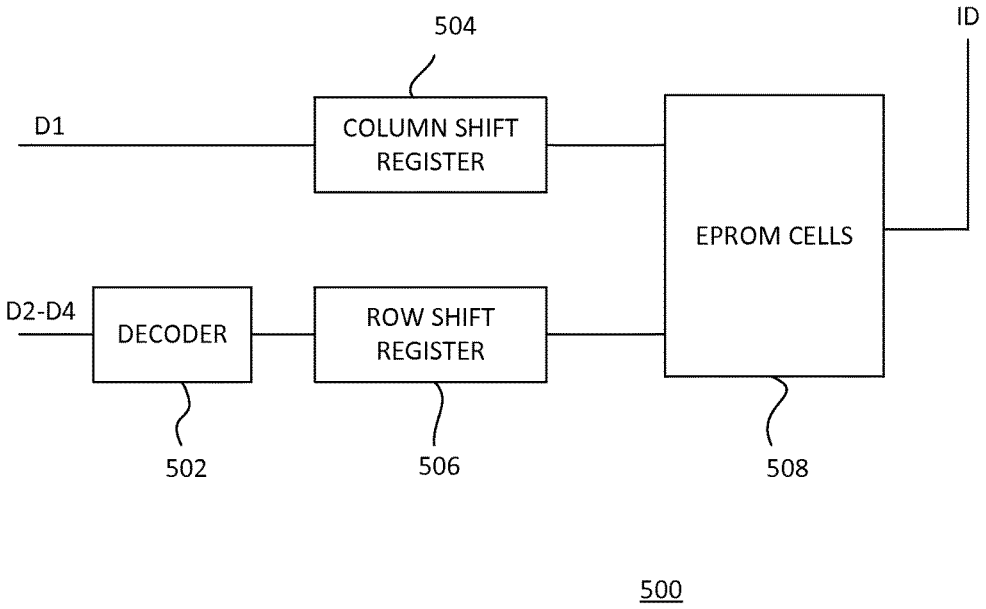
FIG. 5 is a block diagram depicting an EPROM subsystem according to an example implementation.

FIG. 5 is a block diagram depicting an EPROM subsystem 500 according to an example implementation. The EPROM subsystem 500 includes EPROM cells 508, a column shift register 504, a row shift register 506, and a decoder 502. The EPROM cells 508 comprise an array of cells in rows and columns as described above. The column shift register 504 and row shift register 506 provide row and column select signals to the EPROM cells 508 for select particular cells in the array as described above. The only difference from the above described configurations is the use of the input data signals. Above, it is assumed that two independent data signals are used to drive the row and column shift registers respectively (e.g., see FIG. 2). In the present example, one data signal D1 is used to drive the column shift register 504. A combination of data signals D2-D4 are coupled to the decoder 502, which produces a derived data signal for driving the row shift register 506. The decoder 502 can generate an active logic signal based on a particular combination of bits from D2-D4. This combination of bits on D2-D4 uniquely identifies this particular bank of EPROM cells 508. Since there are 8 different combinations possible given D1-D4, 8 different banks can be uniquely addressed given the same set of D1-D4. That is, the subsystem 500 can be replicated for other banks of EPROM cells, where these other decoders are responsive to different combinations of bits on D2-D4. This is merely one example configuration. In other examples, different numbers of data signals can be used in different combinations to address uniquely different numbers of EPROM banks.

In another example, a decoder can be used to multiplex data signals for the column shift register, rather than the row shift register. In another example, decoders can be used to multiplex data signals for both the column shift register and the row shift register.

In various examples described above, the EPROM can be divided into uniquely addressable banks of cells. Such a configuration requires a set of address generating row and column shift registers for each bank of EPROM cells. As each set of row and column shift registers utilize the same clock signals and potentially the same data signals (given data signal multiplexing), busses are required on the printhead to convey the signals among the different circuits. Referring to FIG. 2, in one example, K equals one and there is only a single bank of 204-1 of EPROM cells. In order to store the same amount of information as the multi-bank example, a single-bank example must have a larger array of EPROM cells.

For example, consider an example where there are 8 banks of 8×8 EPROM cells for a 512-bit EPROM. For each bank, row and column shift registers would have 8 register locations. The same 512-bit EPROM can be configured into a single bank of EPROM cells having, for example, 16 columns and 32 rows. In such an example, the row shift register would have 32 register locations and the column shift register would have 16 register locations. Busses could be eliminated as only a single set of row and column shift registers are used.

Figure 6:
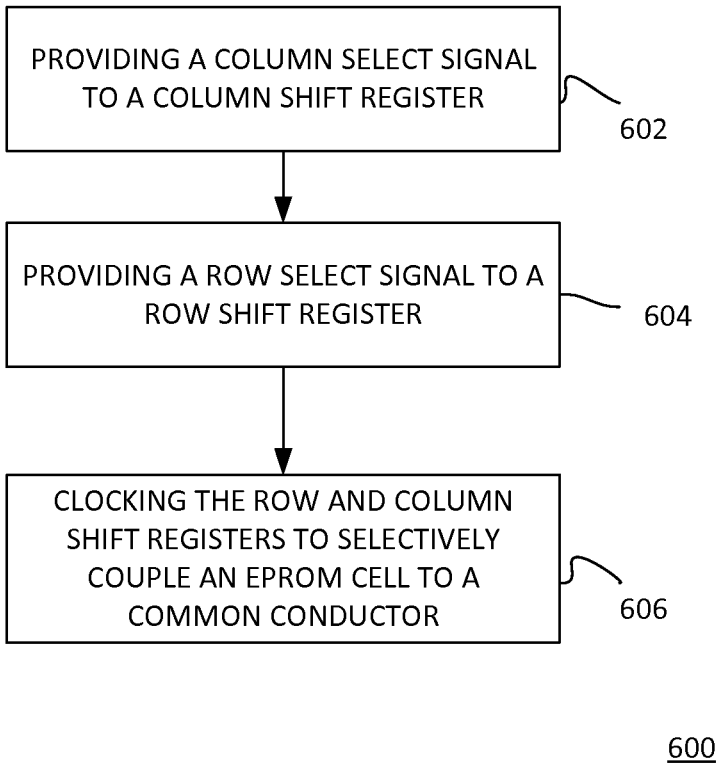
FIG. 6 is a flow diagram depicting a method of addressing an EPROM on a printhead according to an example implementation.

FIG. 6 is a flow diagram depicting a method 600 of addressing an EPROM on a printhead according to an example implementation. The method 600 begins at step 602, where a column select signal is provided to a column shift register. At step 604, a row select signal is provided to a row shift register. At step 606, the row and column shift registers are clocked to selectively couple an EPROM cell to a common conductor (e.g., the ID line described above). In an example, the column select signal and row select signal are derived from a plurality of external control signals (e.g. provided by the controller 102 in FIG. 1). In an example, at least one of the column and row select signals is derived from a combination of the external control signals (e.g., using a decoder, as described above).

Figure 7:
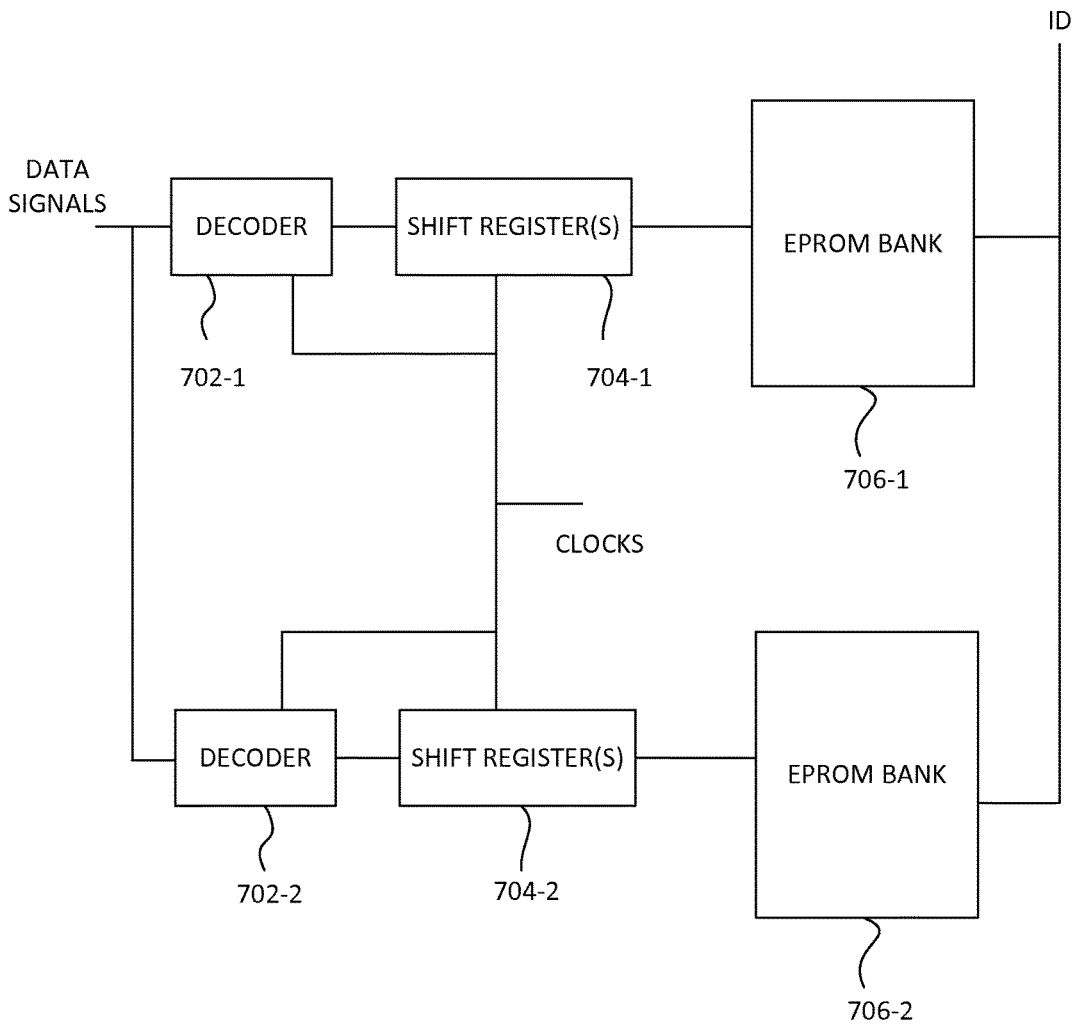
FIG. 7 is a block diagram depicting an EPROM subsystem according to an example implementation.

FIG. 7 is a block diagram depicting an EPROM subsystem 700 according to an example implementation. The EPROM subsystem 700 includes a plurality of EPROM banks 706, e.g., EPROM banks 706-1 and 706-2 are shown. Each of the EPROM banks 706 are addressed using a decoder 702 and shift register(s) 704, e.g., decoders 702-1 and 702-2 and shift registers 704-1 and 704-2 are shown. Shift registers 704 are also referred to as "shift register circuits". Each of the EPROM banks 706 are accessed by the ID line, as noted above. The decoders 702 and shift registers 704 operate based on the clock signals (clocks), e.g., clocks S1-S6 or any subset thereof. In an example, the clock signals comprise phase-shifted replicas of a periodic pulse signal. Each set of shift register(s) 704-1, 704-2, etc. can include one shift register or two shift registers (e.g., a row shift register and a column shift register, as discussed above).

The EPROM banks 706 are addressed using a logical combination of the data signals (e.g., data signals D1-D4 or any subset thereof). The decoders 702 are configured to detect particular logical combinations where each logical combination uniquely identifies a particular EPROM bank 706. For example, when the decoder 702-1 detects a particular logical combination of data signals associated with EPROM bank 706-1, then EPROM bank 706-1 will be addressed and the other EPROM banks 706 are not addressed. For the non-addressed EPROM banks 706, the respective decoders 702 effectively disable address signals for the non-addressed EPROM banks 706. For the addressed EPROM bank 706-1, the decoder 702-1 enables address signals for the EPROM bank 706-1. Any of the EPROM banks 706 can be addressed similarly. In this manner, more EPROM banks 706 can be addressed by a given set of data signals as compared to using one data signal per bank.

In an example, the decoders 702 each generate input signals for their respective shift registers 704. The shift registers 704 sample the input signals to generate address data for their respective banks. To select a cell in an EPROM bank, an asserted logic value is shifted into particular locations of the associated shift register to identify a particular row and column in that bank. When a decoder 702 detects its particular logic combination of the data signals, the decoder 702 generates an input signal that includes the asserted logic value that can be sampled by the respective shift register 704. Otherwise, the decoder 702 generates an input signal that is always de-asserted logically.

In an example, each shift register circuit 704 includes a single shift register for addressing both the row and column of a particular bank. In another example, as discussed above, the shift register circuit 704 can include both a row shift register and a column shift register. In such an example, one of the row and column shift registers can sample the decoder output, while the other shift register can sample a separate data signal (see FIG. 5). In another example, the decoders can drive both the row and column shift registers.

Figure 8:
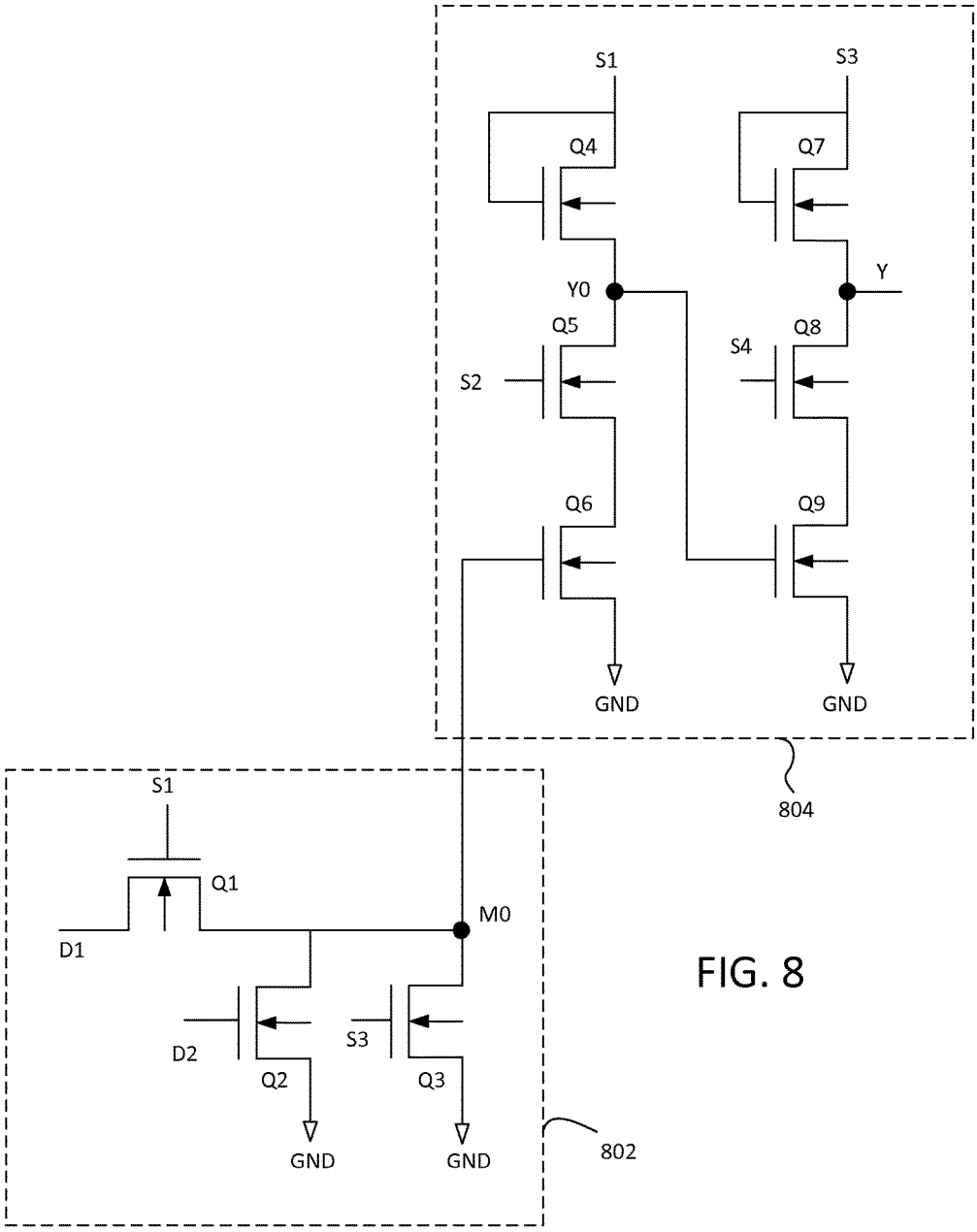
FIG. 8 is a schematic diagram depicting an example implementation of a decoder driving a shift register.

FIG. 8 is a schematic diagram depicting an example implementation of a decoder 802 driving a shift register 804. In the present example, assume the shift register 804 is a single shift register for generating row and column address data, of which a single register location is shown. Also, assume there are four EPROM banks referred to as banks B1 through B4, and two data signals D1 and D2. In order to address four EPROM banks, assume the following truth table:

| D1 | D2 | Bank |
|---|---|---|
| 1 | 0 | B1 |
| 0 | 1 | B2 |
| 1 | 1 | B3 |
| 0 | 0 | B4 |

The decoder 802 includes transistors Q1 through Q3, and the shift register 804 includes transistors Q4 through Q9. Each of the transistors Q1 through Q9 comprises an N-channel field effect transistor (FET). In the decoder 802, the sources of Q2 and Q3 are coupled to a reference voltage (e.g., electrical ground or GND). The drains of Q2 and Q3 are coupled to a node M0. The gate of Q2 receives signal data signal D2, and the gate of Q3 receives clock signal S3. The source of transistor Q1 is coupled to the node M0. The drain and gate of transistor Q1 receive data signal D1 and clock signal 1, respectively.

In the shift register 804, the gate and drain of transistor Q4 receive clock signal S1. The source of transistor Q4 is coupled to the node Y0. The gate and drain of transistor Q7 receive clock signal S3. The source of transistor Q7 is coupled to the node Y. The drains of transistors Q5 and Q8 are coupled to the nodes Y0 and Y, respectively. The sources of transistors Q5 and Q8 are coupled to the drains of transistors Q6 and Q9, respectively. The sources of transistors Q6 and Q9 are coupled to the reference voltage (e.g., GND). The gate of transistor Q6 is coupled to the node M0, and the gate of transistor Q9 is coupled to the node Y0.

Figure 9:
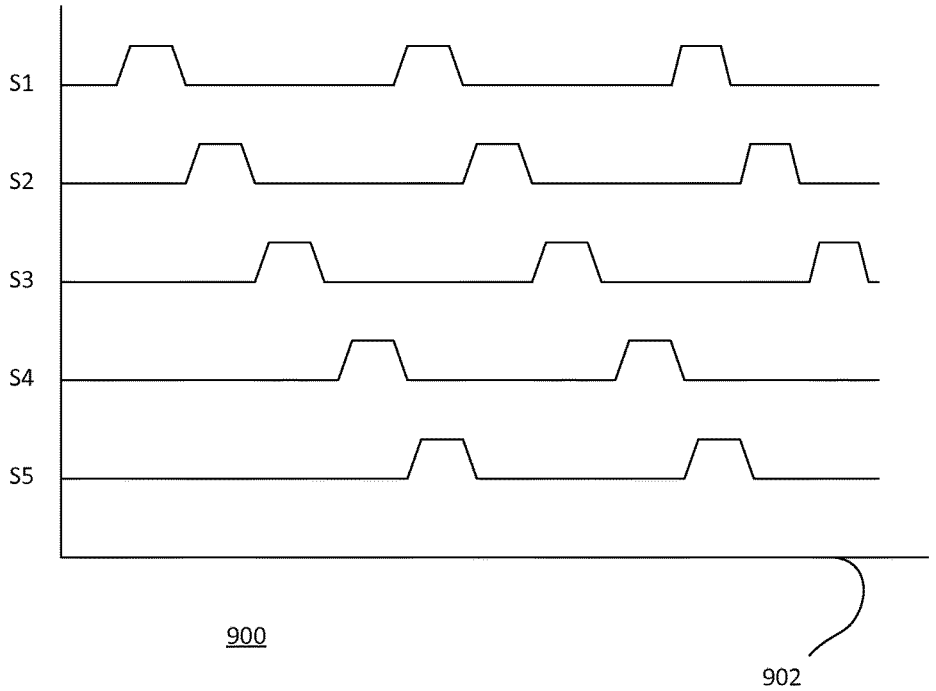
FIG. 9 is a graph depicting an example implementation of clock signals S1 through S5 along a time axis.

FIG. 9 is a graph 900 depicting an example implementation of the clock signals S1 through S5 along a time axis 902. As shown, the clock signals S1 through S5 are each a periodic sequence of pulses with sequential phase offset such that the pulse on S2 occurs after the pulse on S1, the pulse on S3 occurs after the pulse on S2, etc. Returning to FIG. 8, assume bank B1 is being addressed and the data signals D1 and D2 are logic 1 and logic 0, respectively. The circuit operates as follows: during S1, the node Y0 will be charged (e.g., logic 1). At the same time, Q1 will turn on and charge node M0. Since D2 is logic 0, the node M0 will remain charged (i.e., the transistor Q2 remains off). During S2, the node Y0 will be evaluated through the node M0, since M0 charged. Thereafter, Y0 will be discharged and become logic 0 (i.e., the transistors Q5 and Q6 are both on and pull node Y0 to logic 0). During S3, the node Y will be charged and the node M0 will be discharged (the transistor Q3 turns on and pulls node M0 to logic 0). During S4, the node Y will be evaluated by the node Y0. Since Y0 is logic 0, the transistor Q9 is off and thus Y remains charged. The node Y is the output of the first register location in the shift register 804 and can provide input to another register location in the shift register 804 (e.g., driving a node M1 for a next location not shown). In this manner, a sequence of bits can be loaded into the shift register 804.

Consider the circuit of FIG. 8 when other banks B2-4 are being addressed. When bank B2 is addressed, D1 is logic 0 and D2 is logic 1. Since D2 is logic 1, the transistor Q2 is on and the node M0 is discharged (logic 0). Hence the node Y0 will remain logic 1 after S2, keeping transistor Q9 on. During S4, the node Y will be pulled to logic 0 and no bit will be loaded into the shift register. Hence, the bank B1 will not be addressed while the bank B2 is being addressed.

When bank B3 is addressed, both D1 and D2 are logic 1. Since D2 is logic 1, the transistor Q2 is on and the node M0 is discharged (logic 0) and operation proceeds as above in the bank B2 example. Hence, the bank B1 will not be addressed while the bank B3 is being addressed.

When bank B4 is a addressed, both D1 and D2 are logic 0. Since D1 is logic 0, the transistor Q1 will pass logic 0 to the node M0. Since M0 is discharged during S2, operation proceeds as above in the banks B2 and B3 examples. Hence, the bank B1 will not be addressed while the bank B4 is being addressed.

Figure 10:
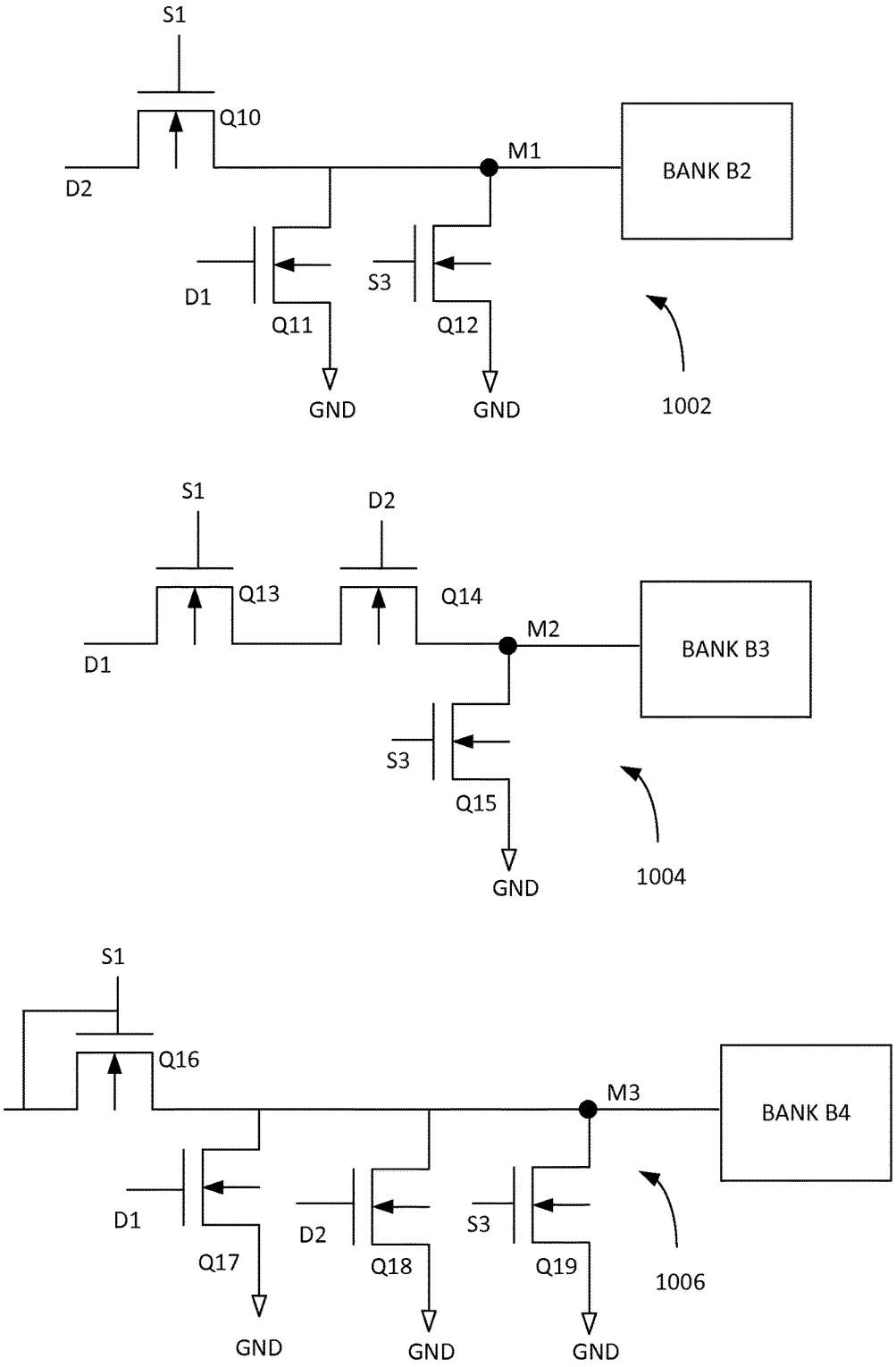
FIG. 10 depicts schematic diagrams showing decoder circuits for banks a plurality of EPROM banks according to example implementations.

FIG. 10 depicts schematic diagrams showing decoder circuits for banks B2 through B4 in the example implementation described above. The shift registers have the same implementation as shown for bank B1 shown in FIG. 8 and the details are omitted for clarity. For the bank B2, the decoder 1002 includes transistors Q10 through Q12. The transistors Q11 and Q12 are coupled between a node M0 and the reference voltage, and the transistor Q10 is serially coupled between D2 and M1. The gates of transistors Q11 and Q12 are driven by D1 and S3. If D1 is logic 0 and D2 is logic 1, then M1 will be charged (logic 1) when S2 occurs and bank 2 will be addressed as described above in the bank B1 example. Note than in other logic combinations of D1 and D2, the node M1 will be discharged during S2 and bank B2 will not be addressed.

For the bank B3, the decoder 1004 includes transistors Q13 through Q15. The transistor Q15 is coupled between a node M2 and the reference voltage. The transistors Q13 and Q14 are serially coupled between D2 and the node M2. The gates of transistors Q13, Q14, and Q15 are driven by S1, D2, and S3, respectively. If D1 and D2 are both logic 1, then M2 will be charged (logic 1) when S2 occurs and bank 3 will be addressed as described above in the bank B1 example. Note than in other logic combinations of D1 and D2, the node M2 will be discharged during S2 and bank B3 will not be addressed.

For the bank B4, the decoder 1006 includes transistors Q16 through Q19. The transistors Q17 through Q19 are coupled between a node M3 and the reference voltage. The transistor Q16 is serially coupled between S1 and M3. The gates of transistors Q16 through Q19 are driven by S1, D1, D2, and S3 respectively. If D1 and D3 are both logic 0, then M3 will be charged (logic 1) when S2 occurs and bank 4 will be addressed as described above in the bank B1 example. Note than in other logic combinations of D1 and D2, the node M3 will be discharged during S2 and bank B4 will not be addressed.

FIGS. 8-10 show one example implementation of the subsystem 700 shown in FIG. 7. There may be different numbers of data signals, EPROM banks, and clock signals. The circuitry of the decoders can be adapted based on the number of data signals, the number of EPROM cells, and the number of clock signals such that they exclusively address individual EPROM banks based on logical combinations of the data signals.

Figure 11:
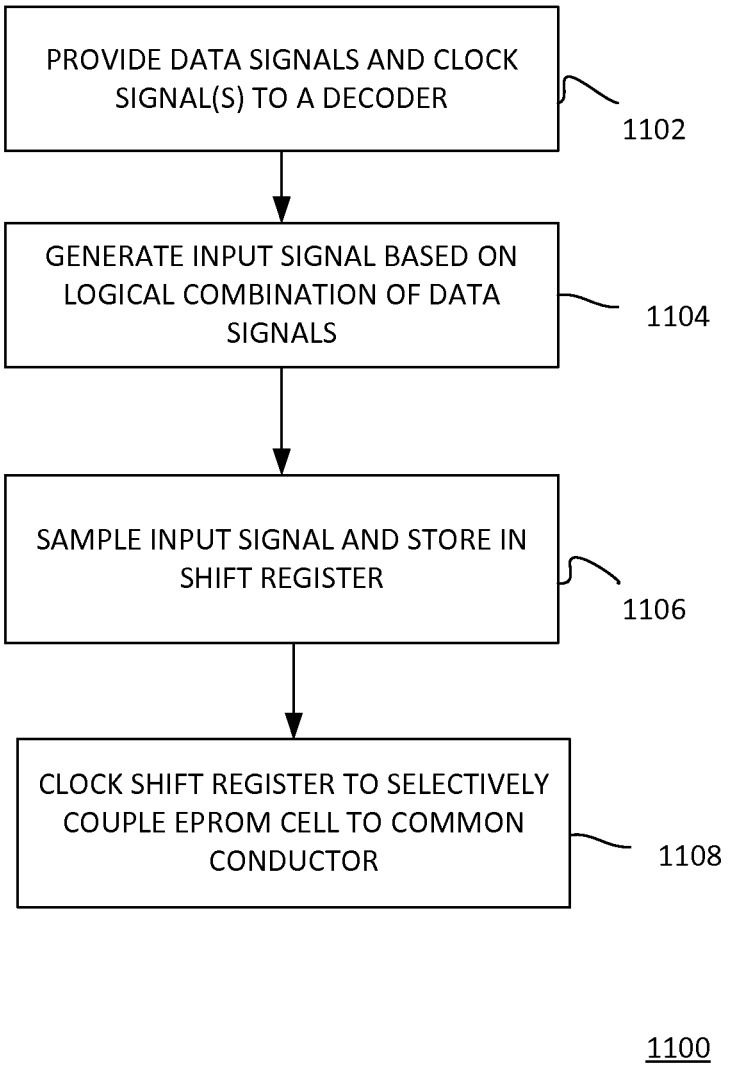
FIG. 11 is a flow diagram depicting a method of addressing an EPROM on a printhead according to an example implementation.

FIG. 11 is a flow diagram depicting a method 1100 of addressing an EPROM on a printhead according to an example implementation. The method 1100 begins at step

1102, where a plurality of data signals and at least one of a plurality of clock signals are provided to a decoder. At step 1104, an input signal is generated in response to a logical combination of the plurality of data signals. At step 1106, a sample of the input signal is stored in a shift register circuit. At step 1108, the shift register circuit is clocked to selectively couple cell in the EPROM to a common conductor.

In the foregoing description, numerous details are set forth to provide an understanding of the present invention. However, it will be understood by those skilled in the art that the present invention may be practiced without these details. While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A printhead, comprising:

an electronically programmable read-only memory (EPROM) having a bank of cells arranged in rows and columns, each of the cells having a addressing port, a row select port, and a column select port;

a conductor coupled to the addressing portion of each of the cells;

a shift register circuit coupled to at least one of the row select port and the column select port of each of the cells, the shift register circuit storing samples of an input signal responsive to a plurality of clock signals; and a decoder coupled to the shift register circuit to provide the input signal based on a logical combination of a plurality of data signals and at least a portion of the clock signals, wherein the plurality of clocks comprises phase-shifted replicas of a periodic pulse signal.

2. The printhead of claim 1, wherein the decoder provides an asserted logic signal in response to a specific logic combination of the plurality of data signals, and a de-asserted logic signal in response to all other logic combinations of the plurality of data signals.

3. The printhead of claim 1, wherein the shift register circuit comprises a row shift register coupled to the row select port of the cells and a column shift register coupled to the column select port of the cells.

4. The printhead of claim 3, wherein one of the row shift register and the column shift register store samples of the input signal, and where the other of the row shift register and the column shift register store samples of another data signal not part of the plurality of data signals.

5. A printhead, comprising:

an electronically programmable read-only memory (EPROM) having a plurality of banks, each of the plurality of banks having a plurality of cells arranged in rows and columns, each of the cells having a addressing port, a row select port, and a column select port;

a conductor coupled to the addressing port of each of the plurality of cells in each of the plurality of banks;

shift register circuits coupled to the banks, each shift register circuit being coupled to at least one of the row select port and the column select port of each of the cells in a respective bank and storing samples of an input signal responsive to a plurality of clock signals; and decoders coupled to the shift register circuits to provide the input signals based on logical combinations of a plurality of data signals and at least a portion of the clock signals, wherein the plurality of clocks comprises phase-shifted replicas of a periodic pulse signal.

6. The printhead of claim 5, wherein each of the decoders provides an asserted logic signal in response to a specific logic combination of the plurality of data signals, and a de-asserted logic signal in response to all other logic combinations of the plurality of data signals.

7. The printhead of claim 5, wherein each of the shift register circuits comprises a row shift register coupled to the row select port of the cells and a column shift register coupled to the column select port of the cells.

8. The printhead of claim 7, wherein, for each of the shift register circuits, one of the row shift register and the column shift register store samples of the respective input signal, and where the other of the row shift register and the column shift register store samples of another data signal not part of the plurality of data signals.

9. A method of addressing an electronically programmable read-only memory (EPROM) on a printhead, comprising:

providing a plurality of data signals and at least one of a plurality of clock signals to a decoder;

generating an input signal in response to a logical combination of the plurality of data signals;

storing a sample of the input signal in a shift register circuit; and clocking the shift register circuit to selectively couple a cell in the EPROM to a common conductor, wherein the plurality of clocks comprises phase-shifted replicas of a periodic pulse signal.

10. The method of claim 9, wherein the decoder provides an asserted logic signal as the input signal in response to a specific combination of the plurality of data signals, and a de-asserted logic signal in response to all other logic combinations of the plurality of data signals.

* * * * *